United States Patent [19]

Sandberg et al.

[11] Patent Number: 4,545,283

[45] Date of Patent: Oct. 8, 1985

[54] UPHOLSTERY WELT CORD

[75] Inventors: Robert N. Sandberg, Comstock Park; Robert E. Montle, Wyoming, both of Mich.

[73] Assignee: Sackner Products, Inc., Grand Rapids, Mich.

[21] Appl. No.: 530,416

[22] Filed: Sep. 8, 1983

[51] Int. Cl.[4] ..... D04C 1/02; D04C 1/06

[52] U.S. Cl. ..... 87/6; 57/235; 57/904; 87/1; 87/2; 87/7; 87/29

[58] Field of Search ..... 87/1–9, 87/28–30; 57/233–235, 904

[56] References Cited

U.S. PATENT DOCUMENTS

| | | | |
|---|---|---|---|
| 1,821,582 | 9/1931 | Sackner | 57/235 X |
| 2,107,467 | 2/1938 | Buhler | 87/6 |
| 2,165,296 | 7/1939 | Oass | 57/904 X |
| 2,248,123 | 7/1941 | Sackner | 57/233 X |
| 2,503,791 | 4/1950 | Boersma | 87/6 |
| 2,550,776 | 7/1941 | Sackner | 57/234 X |
| 2,557,343 | 6/1951 | Cook | 87/1 |
| 2,722,861 | 11/1955 | Francis | 87/1 |
| 2,741,149 | 4/1956 | Francis | 87/1 |
| 2,816,415 | 12/1957 | Lappala | 57/904 X |
| 2,979,982 | 4/1961 | Weitzel | 87/6 |
| 3,129,631 | 4/1964 | Hill et al. | 87/6 |

FOREIGN PATENT DOCUMENTS

| | | | |
|---|---|---|---|
| 2941897 | 4/1981 | Fed. Rep. of Germany | 57/904 X |
| 54-112241 | 9/1979 | Japan | 57/904 X |

*Primary Examiner*—John Petrakes

*Attorney, Agent, or Firm*—Price, Heneveld, Huizenga & Cooper

[57] ABSTRACT

A fire retardant welt or beading cord having an aluminum foil element provided to dissipate the heat but which normally would be distorted when bent, in which cord memory is provided by an inner core formed from an elongated cylindrical, flexible member, preferably a foamed, flexible polymer.

7 Claims, 5 Drawing Figures

UPHOLSTERY WELT CORD

BACKGROUND OF THE INVENTION

This invention relates to improvements in a welt or beading cord having a cellulose filler body with a braided jacket and particularly to such a cord which is fire retardant. Welt or beading cords with braided jackets over an all-cellulose filler material are generally known to be old, as disclosed by U.S. Pat. Nos. 1,821,582, 2,248,123, 2,250,776, 2,722,861, and 2,741,149. However, with the advent of government regulations relating to safety standards for more fire-safe furniture, the upholstery furniture industry has voluntarily adopted an action program for making better flamability-resistant upholstered furniture, including every component of the furniture. Therefore, a need has been expressed for a smolder-resistant, flame-retardant welt or beading.

This need has been partially satisfied by a construction in which an aluminum foil is incorporated within the welt cord, such foil extends the entire length of the cord so as to provide a heat sink or heat dissipating material that will carry the heat away when a cigarette or other heated object is placed on the cord.

Although such a welt cord with an aluminum foil strip accomplishes the heat-retardant function, it has inherent disadvantages. One of these disadvantages is that the aluminum foil will cause the cord to be deformable. In other words, when the cord is bent, the aluminum foil is distorted, causing the cord to retain that bend because of the lack of flexibility or memory of the cord resulting from the distortion of the aluminum foil.

In fact, where the bend is made, the entire cylindrical shape of the cord is distorted. This is a very undesirable characteristic of this prior art cord because it is extremely important that the cord maintain its shape on the edge of the cushion or other object on which it is located. Thus, the prior art welting cord generally acceptable under the regulations established by the upholstered furniture industry is not entirely satisfactory.

SUMMARY OF THE INVENTION

In accordance with this invention, we conceived of a construction which can use the advantage of the aluminum foil for dissipating the heat but at the same time provide a cord that is flexible and will retain its shape when bent around corners. Further, our welting cord construction supplies memory to the cord so that it will tend to be straight and thus retain all the functions of prior art cords without the aluminum foil.

In accordance with this invention, we provide a construction in which the prior art cord with the aluminum foil, as described above, is provided with an inner core formed from a foamed, flexible polymer. This inner core assists in retaining the cylindrical shape of the cord and also gives memory to the cord so that in being bent around corners, the distortion retaining force of the aluminum foil is overcome by the memory of the inner core. Thus the cord has sufficient memory to retain the shape of the cord when bent around such corners.

Within a more narrower aspect of our invention as applied to larger diameter cords, we provide a non-woven polyester twisted and formed about the inner core around which the compressed crepe sheets of cellulose wadding is located and held in place with a jacket of threads. In this combination, the inner core serves the identical function of retaining the memory and the shape of the cord.

DETAILED DESCRIPTION OF THE PREFERRED EMBODIMENTS

Figure 1:
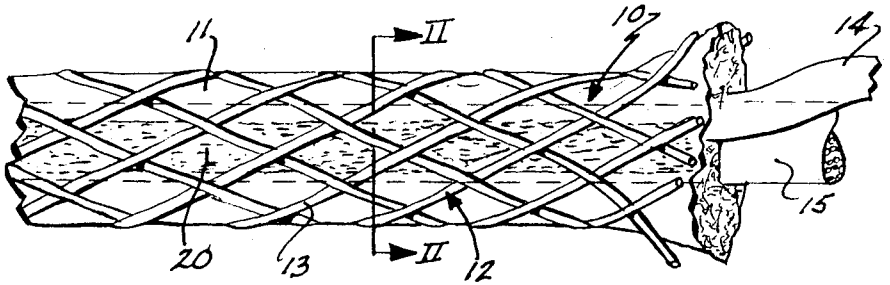
FIG. 1 is a side elevational view of a section of the cord made in accordance with this invention.

Referring to the drawings, FIG. 1 discloses one embodiment of our invention which comprises the cord 10 consisting of a body portion 11, the outer portion thereof being made of a wadded cellulose tissue material. This material consists of assembled sheets of thin, crepe cellulose tissue wadded and made into a substantially cylindrical body 11 retained in the shape as shown by the jacket 12 consisting of the spirally wound wrapping threads 13. To assist the threads or strands 13 in retaining the body in its desired form, a strip 20 of flexible adhesive extending longitudinally of the body and across the threads or strands is applied.

Inside the body 11 are two important elements including the aluminum foil strip of 14 which extends the length of the cord. Inwardly of the aluminum strip 14 is an inner core 15 formed from a foamed, flexible polymer.

Referring specifically to each of the elements making up the cord of this invention, the inner core 15 is a foamed, extruded core, specifically constructed of a cellular foam polyethylene formed by mixing pellets of a polymeric material with a suitable blowing agent within a housing or container, the blowing agent being used only in sufficient quantities to foam the polymeric material. The mixture is then heated to a temperature sufficient to completely decompose the agent and thereafter the mixture is extruded in a well-known way through a die. This method is described in greater detail in U.S. Pat. No. 3,876,495, the only difference in such patent being that its core is either hollow, having a passageway approximately through the center thereof, or includes a reinforcing member centered therein and extending substantially along the entire length of the core. So far as the inner core material is concerned, the disclosure of U.S. Pat. No. 3,876,495 is incorporated herein by reference.

The aluminum foil 14 is a very well-known product manufactured by such companies as Reynolds Aluminum and Alcoa. It is a thin strip of material having a thickness of ½ to 1 mil. Such material is like that sold in food stores and the like for wrapping foods such as meats. For the purpose of this invention, it is supplied in long bands or strips for feeding the machine for making the cord, as will be described hereinafter.

As previously described, the body 11 is constructed of wadded cellulose tissue supplied in strips of cellulose fiber stock to the machine for manufacturing the cord in a well-known manner. The threads or strands 13 are, in the preferred embodiment, constructed of glass fibers but could be made of cotton or any other material.

Figure 5:
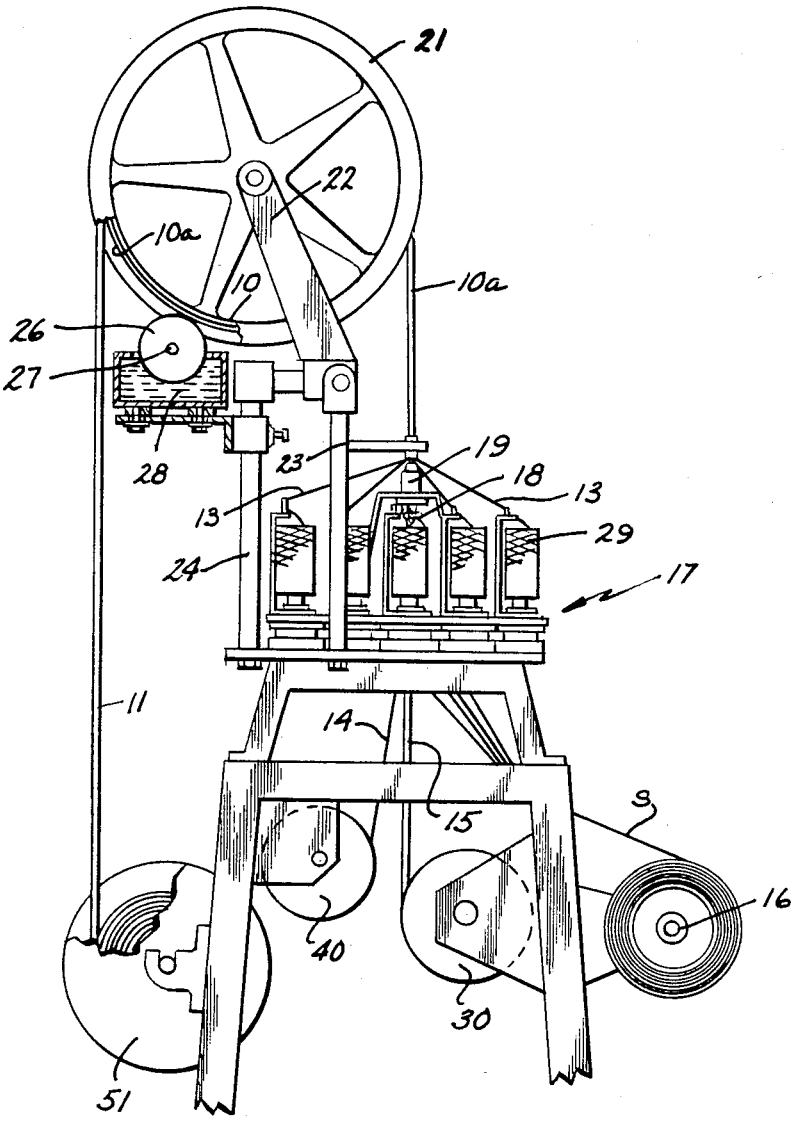
FIG. 5 is an elevational view of apparatus for constructing the cord of FIGS. 1 and 2.

The threads or strands 13 are braided onto the body 11 by means of a machine like that disclosed in U.S. Pat. No. 2,741,149. Such machine, disclosed in FIG. 5, is generally designated by the reference numeral 17. It includes a wadding roll 7 mounted on a spindle 16 for carrying the roll 7. A strip of cellulose material S on the roll 7 is adapted to be unwound from the roll, crumpled and creped into the form as represented by the reference numeral 18. Also mounted on the machine 17 is the roll 30 carrying the core 15. The core 15 is unwound from the roll 30 from whence it is pulled through the compressing eye 19 through which the strip S is also pulled to form the body 11.

Also mounted on the machine is the roll 40 carrying the strip of aluminum foil 14. This strip 14 is also pulled through the eye 19 simultaneously with the cellulose strip S and the inner core 16. The force for pulling the cellulose strip S, inner core 15, and aluminum foil strip 14 through the eye 19 is created by the capstan 21 around which the semi-completed, braided cord 10*a* is wound at least one complete warp. This capstan is supporting by the bracket 22 carried by the posts 23 and 24.

As the inner core 15, crumpled strip of cellulose 18 and foil 14 are being pulled through the eye 19, the wrapping strands 13 are drawn from the spools or bobbins 29 which are desirably driven in a conventional manner to braid the strands upon the body 11 as shown by the jacket of the final product as illustrated by FIG. 1. Since braiding machines of this type are known in the art and are very conventional and are described in great detail in U.S. Pat. No. 2,741,149, no further detailed description is considered necessary.

The adhesive strip 20 (FIG. 1) is applied to the cord 10*a* by means of an adhesive applying roller 26 journaled at 27 and dipping into the adhesive fountain 28. The roller contacts the cord 10*a* at a position opposite the fountain 28 so that the roller is driven by the cord at the same time the adhesive on the roller is applied to the cord to produce a strip 20 of adhesive on the cord. (FIGS. 1 and 2) This strip extending across the braided strands secures the strands to the body 11 to maintain the relationship of the jacket to the body as previously described.

A spool or reel 51 is also mounted on the apparatus for storing the finished cord 11. The finished cord is that disclosed in FIG. 1. It is a unique cord in that it is soft but yet sufficiently firm to provide a bead at the edge of a furniture piece such as a cushion. It satisfies the flame-retardant characteristics of the prior art cords previously described and, at the same time, has all of the characteristics desired of cords of this type. That is, softness, resiliency, flexibility, firmness, smoothness and uniform cross section. The important function of this cord as opposed to the prior art flame-retardant cords with aluminum foil is that the inner core 15 maintains these characteristics regardless of whether the cord is bent around sharp corners. The reason for this is that the inner core 15 has a memory greater than the force tending to retain the distortion of the aluminum foil when the cord is bent. In other words, without the inner core 15, when the cord is bent around a sharp corner, the aluminum foil is distorted and sometimes crushed, causing the cord to retain that bent shape and thus destroying an important characteristic required of cords of this type. However, with the inner core as disclosed, when the cord is bent around a short corner, the memory of the inner core makes the cord "bounce" back into its original shape when released. Therefore, no kinking or distortion of the cord results from bending it around sharp corners, and the cylindrical shape of the cord is maintained.

MODIFICATION

Figure 2:
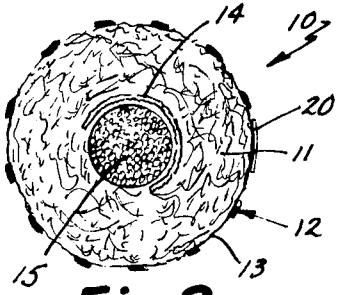
FIG. 2 is a cross-sectional view taken along the plane II—II of FIG. 1.
Figure 3:
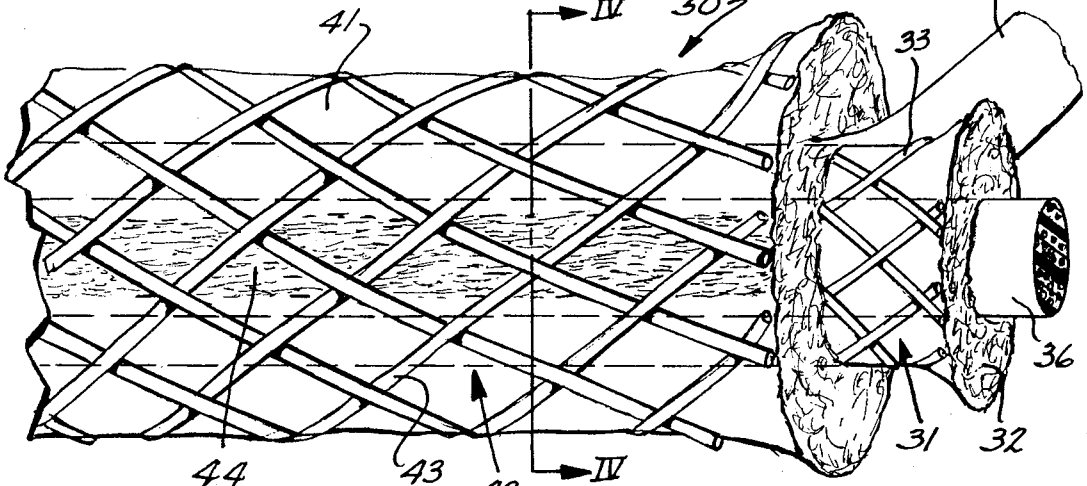
FIG. 3 is a side-elevational view of a section of a modified cord made in accordance with this invention.
Figure 4:
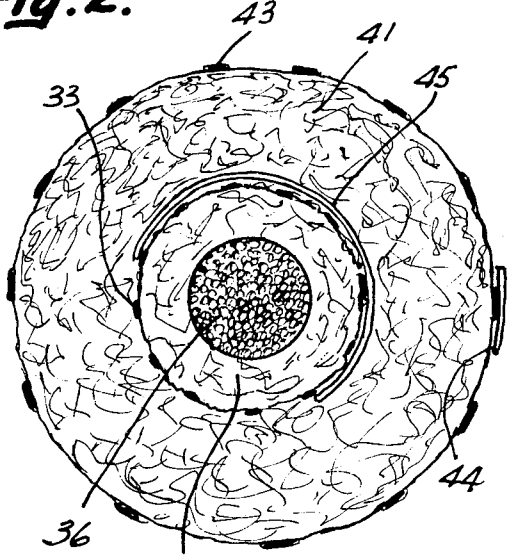
FIG. 4 is a cross-sectional view taken along the plane IV—IV of FIG. 3.

FIGS. 3 and 4 disclose another modification of this invention which is very similar to that of FIGS. 1 and 2. This modification is especially adaptable for larger diameter cords of one-half inch or more. In this cord, an inner subassembly core 31 is provided. This subassembly core 31 is constructed of the inner core 36 surrounded by a non-woven polyester 32 of the type sold under the trademark "REEMAY" by Dupont. This subassembly 31 is formed by braiding the threads or strands 33 about the crumpled non-woven polyester material 31 on a machine similar to that of FIG. 5 prior to actually constructing the completed cord.

Located about the inner subassembly 31 is the body 41 of wadded cellulose tissue like that previously described in relating to the body 11. The shape of this body is maintained by the jacket 42 comprising the strands or threads 43, also constructed of the same material as the strands or threads 13 previously described. The strands 13 are held in place by the adhesive strip 44. Located between the outer surface of the body 41 and the inner subassembly 31 is the aluminum foil strip 45 extending the entire length of the cord and surrounding a substantial portion of the subassembly 31.

This composite cord 50 is constructed on a machine similar to that disclosed in FIG. 5. The only difference is that subassembly 31 is first formed by a similar machine and then stored on a roll such as that disclosed by roll 30 in FIG. 5. The subassembly core is then fed through an eye as disclosed at 16 simultaneously with a strip of cellulose tissue and the strip of aluminum foil 14. It should be evident to one skilled in the art that only minor changes in the manufacturing of cord 10 of FIGS. 1 and 2 are necessary in the method and apparatus for manufacturing the cord 50 of FIGS. 3 and 4, all of such changes being well within the purview of one skilled in the art. Therefore, it is not considered necessary to reillustrate and repeat the manufacturing steps of the cord of FIGS. 3 and 4.

It should also become evident that the cord of FIGS. 3 and 4 also has the same function and advantages as that disclosed in FIGS. 1 and 2. It has the flame-retardant and smolder-resistant characteristics set forth by the policy of the upholstered furniture industry while at the same time having the characteristics required of cords of this type, i.e., softness, resiliency, flexibility, smoothness, firmness and uniform cross section.

Having described our invention, it should be understood that although we have disclosed the preferred embodiments thereof, it is not to be limited thereto, but is intended to include all modifications and embodiments which incorporate the spirit of the invention. We have not attempted to illustrate and describe all of such modifications and embodiments because We believe this disclosure will enable those skilled in the art to embody or adapt our invention as may be desired.

The embodiments of the invention in which an exclusive property or privilege is claimed are defined as follows:

1. In a welting cord comprising compressed crepe sheets of cellulose wadding with at least one continuous sheet of aluminum foil combined therewith and extending the length of said cord for dissipating heat in the event said cord is subjected to heat from a cigarette and the like, said cellulose wadding encompassing said aluminum foil to provide a soft surface to said cord; the outer surface of said cellulose wadding being wrapped with a jacket of threads to maintain the cord-like shape thereof; the improvement comprising: an elongated inner core in said cord, said inner core formed from an elongated cylindrical flexible member having a memory force greater than the shape retaining force of the aluminum foil whereby when the cord is bent, the memory of the composite cord is sufficient to retain the shape of the cord when bent around corners.

2. The core of claim 1 wherein the material of said inner core is a foamed, flexible polymer.

3. The core of claim 1 wherein the material of said inner core consists essentially of cellular foamed polyethylene.

4. The cord of claim 1 in which a non-woven polyester is located between said inner core and said combination of cellulose wadding and aluminum foil.

5. The cord of claim 4 in which the aluminum foil is at least one strip having a width extending a distance at least partially around the circumference of the non-woven polyester portion of the cord, said strip extending lengthwise of the cord, and located between a portion of the cellulose wadding and the non-woven polyester.

6. The cord of claim 4 in which a jacket of threads is wrapped around said non-woven polyester, said strip of aluminum foil extends around a substantial portion of the non-woven polyester, and said cellulose wadding is wrapped around said aluminum foil and held in place by its jacket of threads.

7. The cord of claim 1 in which the aluminum foil is at least one strip having a width extending a distance at least partially around the circumference of said inner core, said strip extending lengthwise of the cord, and located between a portion of the cellulose wadding and the inner core.

* * * * *